US009221571B1

(12) United States Patent
Marr et al.

(10) Patent No.: US 9,221,571 B1
(45) Date of Patent: Dec. 29, 2015

(54) WEIGHTED BAG SUPPORT

(71) Applicants: Timothy Marr, St. Charles, MO (US); Kimberly Collins, St. Charles, MO (US)

(72) Inventors: Timothy Marr, St. Charles, MO (US); Kimberly Collins, St. Charles, MO (US)

( * ) Notice: Subject to any disclaimer, the term of this patent is extended or adjusted under 35 U.S.C. 154(b) by 0 days.

(21) Appl. No.: 14/662,614

(22) Filed: Mar. 19, 2015

(51) Int. Cl.

| | |
|---|---|
| ***B65B 67/00*** | (2006.01) |
| ***B65B 67/12*** | (2006.01) |
| ***B65F 1/06*** | (2006.01) |
| ***B31D 5/00*** | (2006.01) |
| *B65D 5/04* | (2006.01) |

(52) U.S. Cl.
CPC ..... *B65B 67/1238* (2013.01); *B31D 5/0086* (2013.01); *B65B 67/1205* (2013.01); *B65F 1/06* (2013.01); *B65D 5/04* (2013.01); *B65F 2240/138* (2013.01)

(58) Field of Classification Search
CPC B65B 67/12; B65B 67/1205; B65B 67/1238; B65B 67/00; B65B 5/029; B65B 5/04; B31D 5/0086
USPC ..... 248/99, 95, 97, 100, 150; 220/495.01, 220/495.11; 222/181.3, 527, 528; 383/33, 383/34, 34.1, 67, 84, 98; 229/117.27, 229/117.35
See application file for complete search history.

(56) References Cited

U.S. PATENT DOCUMENTS

| | | | | |
|---|---|---|---|---|
| 3,827,471 A * | 8/1974 | Gregory | B65D 88/1668 222/181.3 |
| 4,892,223 A * | 1/1990 | DeMent | B65D 5/60 220/495.11 |
| 4,927,104 A * | 5/1990 | Miller | B65B 67/1205 248/150 |
| 4,940,200 A * | 7/1990 | Sawyer | B65B 67/1205 229/108 |
| 5,054,724 A * | 10/1991 | Hutcheson | B65B 67/1227 220/495.11 |
| 5,897,084 A * | 4/1999 | Judge | B65B 67/1205 141/390 |
| 6,007,030 A | 12/1999 | Judge | |
| 8,840,072 B2 * | 9/2014 | Muse | B65B 67/1205 248/95 |

* cited by examiner

*Primary Examiner* — Tan Le
(74) *Attorney, Agent, or Firm* — Crossley Patent Law

(57) ABSTRACT

A weighted bag support including a plurality of rectangular rigid support frames comprising a right support frame, a left support frame, a front support frame, and a back support frame. Each of the plurality of support frames has a top flap. The top flap has a lower edge and an upper edge. A plurality of covers comprising a right cover, a left cover, a front cover, and a back cover are continuously disposed within the right support frame, the left support frame, the front support frame, and the back support frame, respectively. A plurality of weighted rods comprising a right weighted rod, a left weighted, rod, a front weighted rod, and a back weighted rod are disposed within the upper edge of the top flap of the right support frame, the left support frame, the front support frame, and the back support frame, respectively.

7 Claims, 4 Drawing Sheets

WEIGHTED BAG SUPPORT

BACKGROUND OF THE INVENTION

Various types of bag supports are known in the prior art. However, what is needed is a rectangular bag support having a right support frame, a left support frame, a front support frame, and a back support frame. What has been further needed is for each of the right support frame, the left support frame, the front support frame, and the back support frame to be attachable to each other with a plurality of grommets and a plurality of rings. Lastly, what has been needed is for a bag to be configured to fit within an opening disposed between the right support frame, the left support frame, the front support frame, and the back support frame, and for the top flap of each of the right support frame, the left support frame, the front support frame, and the back support frame to be configured to fold over the bag in the opening to secure it in an open position. The weighted bag support can optionally be used with a yard waste bag in order to aid in the process of filling the bag with debris. The weighted bag support can also optionally be used with a fifty-five gallon trash bag at large parties or gatherings, since it is collapsible, portable, and easy to store or transport. The weighted bag support saves a user time and energy by maintaining the structure of a loose bag during use.

FIELD OF THE INVENTION

The present invention relates to bag supports, and more particularly, to a weighted bag support.

SUMMARY OF THE INVENTION

The general purpose of the present weighted bag support, described subsequently in greater detail, is to provide a bag support which has many novel features that result in a weighted bag support which is not anticipated, rendered obvious, suggested, or even implied by prior art, either alone or in combination thereof.

To accomplish this, the present weighted bag support comprises a plurality of rectangular rigid support frames comprising a right support frame, a left support frame, a front support frame, and a back support frame. Each of the plurality of support frames has a right side, a left side, a bottom side, and a top flap. The top flap has a lower edge and an upper edge. The plurality of support frames can optionally be a 12-gauge galvanized steel wire. Each of the front support frame and the back support frame are disposed parallel to each other. Each of the right support frame and the left support frame are disposed parallel to each other. Each of the front support frame and the back support frame are perpendicularly disposed to each of the right support frame and the left support frame. The height of the right support frame, the left support frame, the front support frame, and the back support frame are equal. The width of the right support frame and the left support frame are equal. The width of the front support frame and the back support frame are equal. The width of the top flap of each of the right support frame, the left support frame, the front support frame, and the back support frame tapers from the lower edge to the upper edge.

A plurality of grommets is continuously disposed from proximal the top flap lower edge to proximal the bottom side on each of the right side and the left side of each of the right support frame, the left support frame, the front support frame, and the back support frame. A plurality of rings is attached to the plurality of grommets. Each of the plurality of rings securely engages each of the plurality of grommets on the left side of the right support frame to each of the plurality of grommets on the right side of the front support frame, each of the plurality of grommets on the right side of the right support frame to each of the plurality of grommets on the left side of the back support frame, each of the plurality of grommets on the left side of the left support frame to each of the plurality of grommets on the right side of the back support frame, each of the plurality of grommets on the left side of the front support frame to each of the plurality of grommets on the right side of the left support frame.

A plurality of covers comprises a right cover, a left cover, a front cover, and a back cover. Each of the right cover, the left cover, the front cover, and the back cover is continuously disposed within the right support frame, the left support frame, the front support frame, and the back support frame, respectively. The plurality of covers can optionally be tarpaulin. A plurality of weighted rods comprises a right weighted rod, a left weighted rod, a front weighted rod, and a back weighted rod. Each of the right weighted rod, the left weighted rod, the front weighted rod, and the back weighted rod is disposed within the upper edge of the top flap of the right support frame, the left support frame, the front support frame, and the back support frame, respectively. The plurality of weighted rods can optionally be steel rods. An opening is disposed between the right support frame, the left support frame, the front support frame, and the back support frame.

A bag is configured to fit within the opening. The bag can optionally be a yard waste bag. The top flap of each of the right support frame, the left support frame, the front support frame, and the back support frame is configured to fold over the bag in the opening to secure the bag in an open position. Each of the right support frame, the left support frame, the front support frame, and the back support frame is optionally collapsible onto each other for ease of transport and storage.

Thus has been broadly outlined the more important features of the present weighted bag support so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 5 thereof, an example of the instant weighted bag support employing the principles and concepts of the present weighted bag support and generally designated by the reference number 10 will be described.

Figure 1:
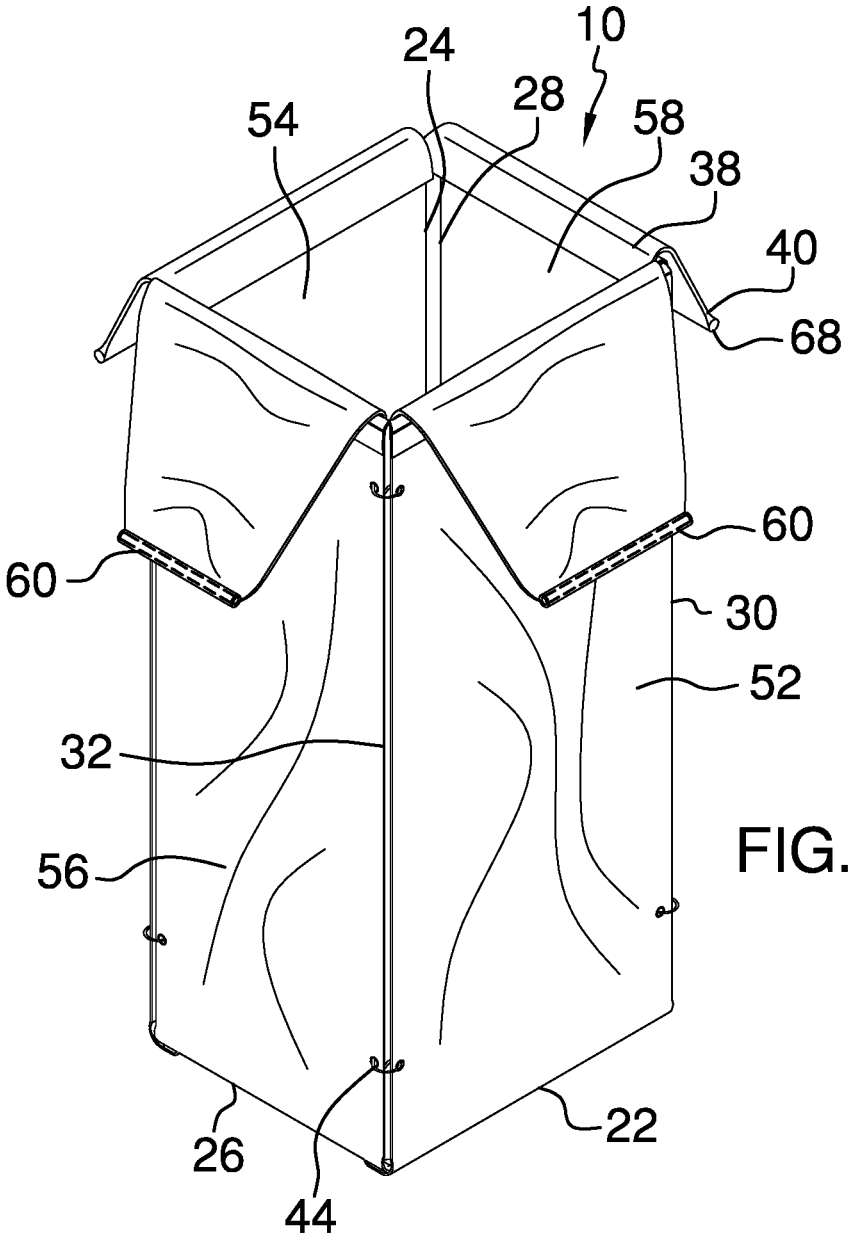
FIG. 1 is a front isometric view.

Referring to FIGS. 1 through 5, the present weighted bag support 10 is illustrated. The weighted bag support 10 comprises a plurality of rectangular rigid support frames 20 comprising a right support frame 22, a left support frame 24, a front support frame 26, and a back support frame 28. Each of the plurality of support frames 20 has a right side 30, a left side 32, a bottom side 34, and a top flap 36. The top flap 36 has a lower edge 38 and an upper edge 40. A plurality of grommets 42 is continuously disposed from proximal the top flap 36 lower edge 38 to proximal the bottom side 34 on each of the right side 30 and the left side 32 of each of the right support frame 22, the left support frame 24, the front support frame 26, and the back support frame 28. A plurality of rings 44 is attached to the plurality of grommets 42. As best shown in FIG. 1, each of the plurality of rings 46 securely engages each of the plurality of grommets 48 on the left side 32 of the right support frame 22 to each of the plurality of grommets 48 on the right side 30 of the front support frame 26, each of the plurality of grommets 48 on the right side 30 of the right support frame 22 to each of the plurality of grommets 48 on the left side 32 of the back support frame 28, each of the plurality of grommets 48 on the left side 32 of the left support frame 24 to each of the plurality of grommets 48 on the right side 30 of the back support frame 28, each of the plurality of grommets 48 on the left side 32 of the front support frame 26 to each of the plurality of grommets 48 on the right side 30 of the left support frame 24.

As best shown in FIG. 1, a plurality of covers 50 comprises a right cover 52, a left cover 54, a front cover 56, and a back cover 58. Each of the right cover 52, the left cover 54, the front cover 56, and the back cover 58 is continuously disposed within the right support frame 22, the left support frame 24, the front support frame 26, and the back support frame 28, respectively.

Figure 2:
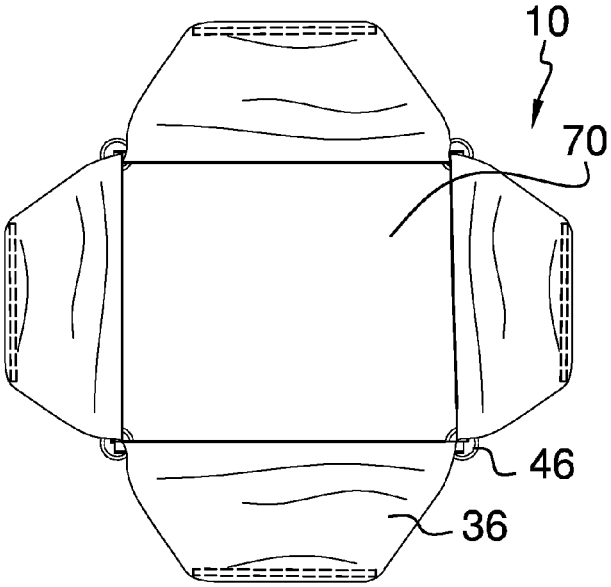
FIG. 2 is a top plan view.
Figure 3:
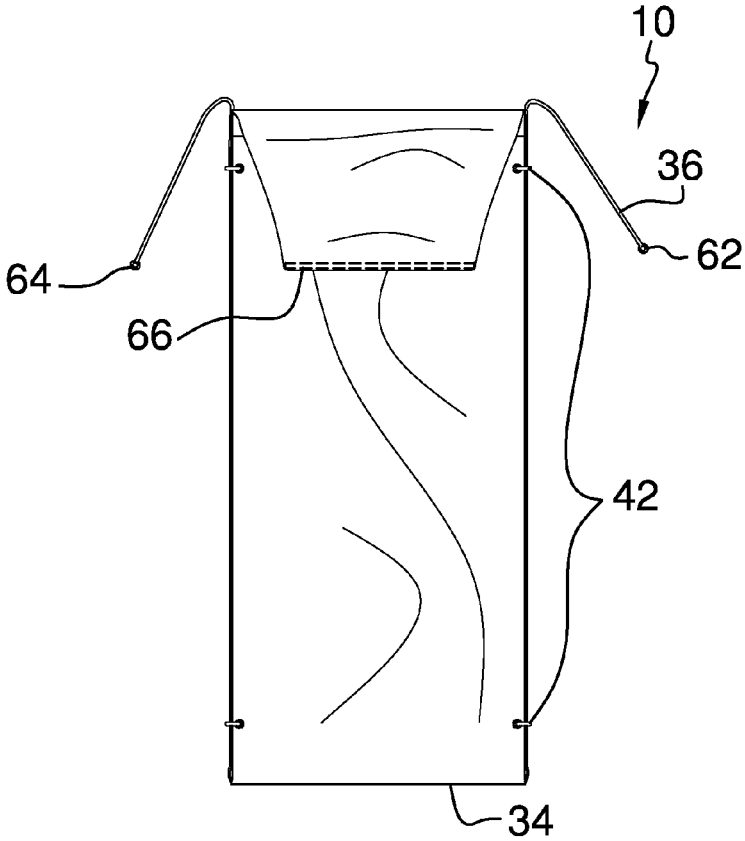
FIG. 3 is a front elevation view.

As best shown in FIG. 2, a plurality of weighted rods 60 comprises a right weighted rod 62, a left weighted rod 64, a front weighted rod 66, and a back weighted rod 68. Each of the right weighted rod 62, the left weighted rod 64, the front weighted rod 66, and the back weighted rod 68 is disposed within the upper edge 40 of the top flap 36 of the right support frame 22, the left support frame 24, the front support frame 26, and the back support frame 28, respectively. An opening 70 is disposed between the right support frame 22, the left support frame 24, the front support frame 26, and the back support frame 28.

Figure 4:
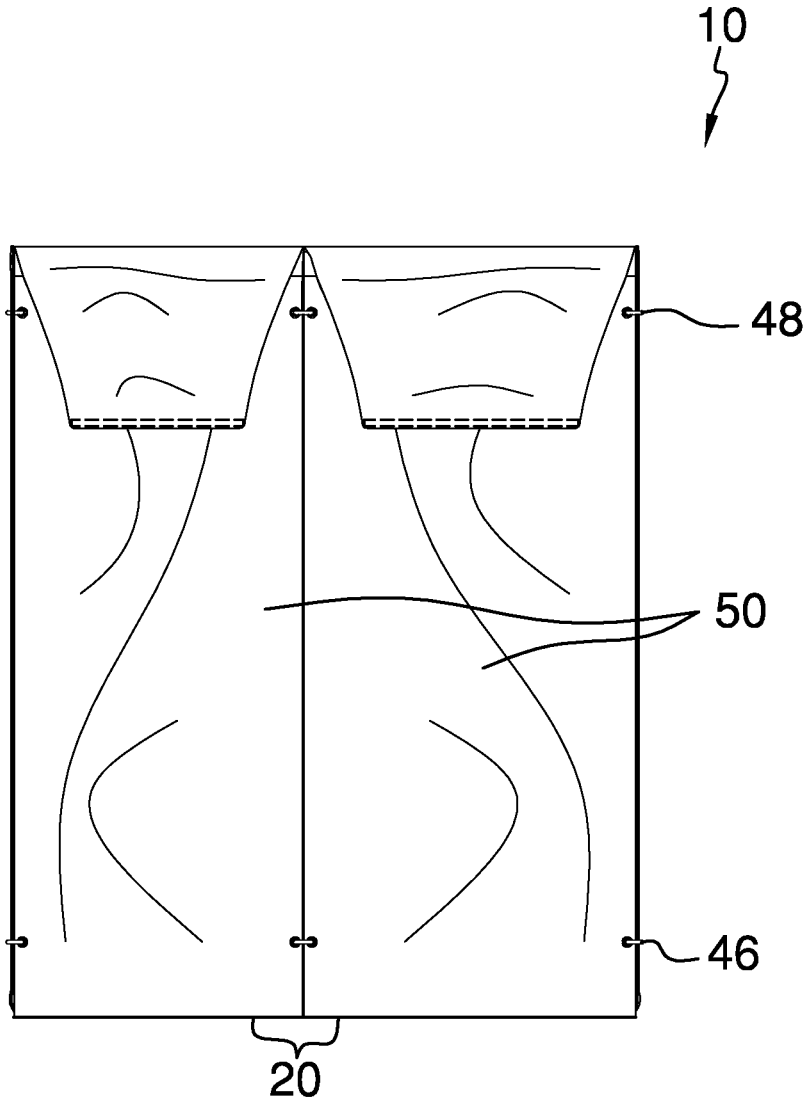
FIG. 4 is a front elevation view showing a plurality of support frames in a collapsed position.
Figure 5:
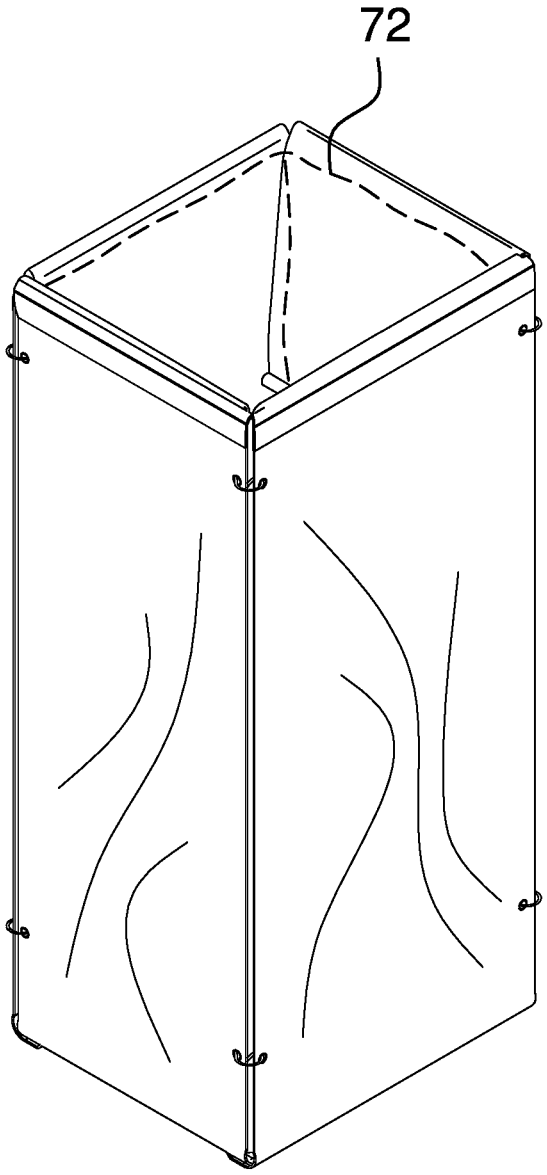
FIG. 5 is an in use view.

As best shown in FIG. 5, a bag 72 is configured to fit within the opening 70. The top flap 36 of each of the right support frame 22, the left support frame 24, the front support frame 26, and the back support frame 28 is configured to fold over the bag 72 in the opening 70 to secure the bag 72 in an open position. As best shown in FIG. 4, each of the right support frame 22, the left support frame 24, the front support frame 26, and the back support frame 28 is optionally collapsible onto each other for ease of transport and storage.

What is claimed is:

1. A weighted bag support comprising:

a plurality of rigid support frames comprising a right support frame, a left support frame, a front support frame, and a back support frame, each of the plurality of support frames having a right side, a left side, a bottom side, and a top flap, the top flap having a lower edge and an upper edge;

wherein each of the front support frame and the back support frame are disposed parallel to each other, each of the right support frame and the left support frame are disposed parallel to each other, each of the front support frame and the back support frame are perpendicularly disposed to each of the right support frame and the left support frame;

wherein the height of each of the right support frame, the left support frame, the front support frame, and the back support frame are equal;

wherein the width of the right support frame and the left support frame are equal, the width of the front support frame and the back support frame are equal;

wherein the width of the top flap of each of the right support frame, the left support frame, the front support frame, and the back support frame tapers from the lower edge to the upper edge;

a plurality of grommets continuously disposed from proximal the top flap lower edge to proximal the bottom side on each of the right side and the left side of each of the right support frame, the left support frame, the front support frame, and the back support frame;

a plurality of rings attached to the plurality of grommets, each of the plurality of rings securely engaging each of the plurality of grommets on the left side of the right support frame to each of the plurality of grommets on the right side of the front support frame, each of the plurality of grommets on the right side of the right support frame to each of the plurality of grommets on the left side of the back support frame, each of the plurality of grommets on the left side of the left support frame to each of the plurality of grommets on the right side of the back support frame, each of the plurality of grommets on the left side of the front support frame to each of the plurality of grommets on the right side of the left support frame;

a plurality of covers comprising a right cover, a left cover, a front cover, and a back cover, each of the right cover, the left cover, the front cover, and the back cover continuously disposed within the right support frame, the left support frame, the front support frame, and the back support frame, respectively;

a plurality of weighted rods comprising a right weighted rod, a left weighted rod, a front weighted rod, and a back weighted rod, each of the right weighted rod, the left weighted rod, the front weighted rod, and the back weighted rod disposed within the top flap upper edge of the right support frame, the left support frame, the front support frame, and the back support frame, respectively; and an opening disposed between the right support frame, the left support frame, the front support frame, and the back support frame;

wherein a bag is configured to fit within the opening, the top flap of each of the right support frame, the left support frame, the front support frame, and the back support frame configured to fold over the bag in the opening to secure the bag in an open position.

2. The weighted bag support of claim 1 wherein each of the right support frame, the left support frame, the front support frame, and the back support frame is configured to be collapsible onto each other from an upright position.

3. The weighted bag support of claim 1 wherein the plurality of support frames is 12-gauge galvanized steel wire.

4. The weighted bag support of claim 1 wherein the plurality of covers is tarpaulin.

5. The weighted bag support of claim 1 wherein the plurality of weighted rods is steel rods.

6. The weighted bag support of claim 1 wherein the opening is configured to fit a yard waste bag inside of it.

7. A weighted bag support comprising:

a plurality of rigid support frames comprising a right support frame, a left support frame, a front support frame, and a back support frame, each of the plurality of support frames having a right side, a left side, a bottom side, and a top flap, the top flap having a lower edge and an upper edge;

wherein each of the front support frame and the back support frame are disposed parallel to each other, each of the right support frame and the left support frame are disposed parallel to each other, each of the front support frame and the back support frame are perpendicularly disposed to each of the right support frame and the left support frame;

wherein the height of each of the right support frame, the left support frame, the front support frame, and the back support frame are equal;

wherein the width of the right support frame and the left support frame are equal, the width of the front support frame and the back support frame are equal;

wherein the width of the top flap of each of the right support frame, the left support frame, the front support frame, and the back support frame tapers from the lower edge to the upper edge;

wherein the plurality of support frames is 12-gauge galvanized steel wire;

a plurality of grommets continuously disposed from proximal the top flap lower edge to proximal the bottom side on each of the right side and the left side of each of the right support frame, the left support frame, the front support frame, and the back support frame;

a plurality of rings attached to the plurality of grommets, each of the plurality of rings securely engaging each of the plurality of grommets on the left side of the right support frame to each of the plurality of grommets on the right side of the front support frame, each of the plurality of grommets on the right side of the right support frame to each of the plurality of grommets on the left side of the back support frame, each of the plurality of grommets on the left side of the left support frame to each of the plurality of grommets on the right side of the back support frame, each of the plurality of grommets on the left side of the front support frame to each of the plurality of grommets on the right side of the left support frame;

a plurality of covers comprising a right cover, a left cover, a front cover, and a back cover, each of the right cover, the left cover, the front cover, and the back cover continuously disposed within the right support frame, the left support frame, the front support frame, and the back support frame, respectively;

wherein the plurality of covers is tarpaulin;

a plurality of weighted rods comprising a right weighted rod, a left weighted rod, a front weighted rod, and a back weighted rod, each of the right weighted rod, the left weighted rod, the front weighted rod, and the back weighted rod disposed within the top flap upper edge of the right support frame, the left support frame, the front support frame, and the back support frame, respectively;

wherein the plurality of weighted rods is steel rods; and an opening disposed between the right support frame, the left support frame, the front support frame, and the back support frame;

wherein a bag is configured to fit within the opening, the top flap of each of the right support frame, the left support frame, the front support frame, and the back support frame configured to fold over the bag in the opening to secure the bag in an open position;

wherein each of the right support frame, the left support frame, the front support frame, and the back support frame is configured to be collapsible onto each other from an upright position.

* * * * *